US010446091B2

(12) United States Patent
Park et al.

(10) Patent No.: US 10,446,091 B2
(45) Date of Patent: Oct. 15, 2019

(54) ELECTRONIC DEVICE AND DISPLAY CONTROL METHOD THEREOF

(71) Applicants: Samsung Electronics Co., Ltd., Suwon-si, Gyeonggi-do (KR); INHA-INDUSTRY PARTNERSHIP INSTITUTE, Incheon (KR)

(72) Inventors: Kee Hyon Park, Suwon-si (KR); Dae Keun Park, Suwon-si (KR); Hun Hee Lee, Suwon-si (KR); Jae Uk Kim, Incheon (KR); Choon Woo Kim, Incheon (KR); Gyoung Soo Park, Incheon (KR); Hye Sung Jang, Incheon (KR)

(73) Assignees: Samsung Electronics Co., Ltd., Suwon-si (KR); INHA-INDUSTRY PARTNERSHIP INSTITUTE, Incheon (KR)

( * ) Notice: Subject to any disclaimer, the term of this patent is extended or adjusted under 35 U.S.C. 154(b) by 268 days.

(21) Appl. No.: 14/628,639

(22) Filed: Feb. 23, 2015

(65) Prior Publication Data

US 2015/0243227 A1 Aug. 27, 2015

(30) Foreign Application Priority Data

Feb. 22, 2014 (KR) ..... 10-2014-0020983

(51) Int. Cl.
*G09G 3/34* (2006.01)

(52) U.S. Cl.
CPC ... *G09G 3/3413* (2013.01); *G09G 2320/0626* (2013.01); *G09G 2320/0666* (2013.01)

(58) Field of Classification Search
CPC ..... G09G 3/3406
See application file for complete search history.

(56) References Cited

U.S. PATENT DOCUMENTS

| | | | | |
|---|---|---|---|---|
| 5,710,876 | A * | 1/1998 | Peercy | G06T 15/506 345/426 |
| 5,757,438 | A * | 5/1998 | Yoon | G09G 5/02 348/602 |
| 8,400,385 | B2 * | 3/2013 | Peng | G09G 3/3426 345/63 |
| 8,405,674 | B2 | 3/2013 | Sakai et al. | |
| 8,749,538 | B2 * | 6/2014 | Webster | G09G 3/3466 345/102 |
| 8,860,653 | B2 | 10/2014 | Mahowald et al. | |
| 9,019,253 | B2 | 4/2015 | Drzaic | |
| 9,355,588 | B2 | 5/2016 | Mahowald et al. | |
| 9,520,075 | B2 | 12/2016 | Cho et al. | |
| 2002/0015043 | A1 * | 2/2002 | Matsuda | G09G 5/00 345/596 |

(Continued)

FOREIGN PATENT DOCUMENTS

| | | | |
|---|---|---|---|
| JP | 2010169922 | A | 8/2010 |
| KR | 1020050059522 | A | 6/2005 |

*Primary Examiner* — Dorothy Harris
(74) *Attorney, Agent, or Firm* — Jefferson IP Law, LLP

(57) ABSTRACT

A display control method of an electronic device is provided. The display control method includes sensing, by the electronic device, a chromaticity and an illuminance of an incident light, calculating an optimal white of a display based on the chromaticity of the incident light, and correcting the calculated optimal white by using the illuminance of the incident light.

12 Claims, 11 Drawing Sheets

(56) References Cited

U.S. PATENT DOCUMENTS

| | | | | |
|---|---|---|---|---|
| 2003/0025709 | A1* | 2/2003 | Kim | G09G 3/20 345/589 |
| 2004/0189630 | A1* | 9/2004 | Huh | G09G 5/00 345/418 |
| 2005/0083293 | A1* | 4/2005 | Dixon | G09G 3/3413 345/102 |
| 2006/0132424 | A1* | 6/2006 | Foo | G02F 1/13318 345/102 |
| 2007/0081102 | A1* | 4/2007 | Ramanath | H04N 5/58 348/602 |
| 2008/0100858 | A1* | 5/2008 | Kondo | G06T 5/008 358/1.9 |
| 2008/0303806 | A1* | 12/2008 | Perrin | G09G 3/3611 345/207 |
| 2008/0303918 | A1* | 12/2008 | Keithley | G09G 3/20 348/223.1 |
| 2010/0188418 | A1 | 7/2010 | Sakai et al. | |
| 2011/0074803 | A1* | 3/2011 | Kerofsky | G09G 3/3406 345/589 |
| 2011/0175925 | A1* | 7/2011 | Kane | G01J 1/42 345/589 |
| 2011/0199350 | A1* | 8/2011 | Wilson | G09G 5/02 345/207 |
| 2012/0050307 | A1 | 3/2012 | Mahowald et al. | |
| 2013/0222408 | A1* | 8/2013 | Lee | G09G 3/3466 345/589 |
| 2014/0063039 | A1 | 3/2014 | Drzaic | |
| 2014/0210847 | A1* | 7/2014 | Knibbeler | G09G 5/006 345/589 |
| 2014/0285477 | A1 | 9/2014 | Cho et al. | |
| 2015/0029168 | A1 | 1/2015 | Mahowald et al. | |
| 2015/0070337 | A1* | 3/2015 | Bell | G09G 3/2003 345/207 |

* cited by examiner

ELECTRONIC DEVICE AND DISPLAY CONTROL METHOD THEREOF

CROSS-REFERENCE TO RELATED APPLICATION(S)

This application claims the benefit under 35 U.S.C. § 119(a) of a Korean patent application filed on Feb. 22, 2014 in the Korean Intellectual Property Office and assigned Serial number 10-2014-0020983, the entire disclosure of which is hereby incorporated by reference.

JOINT RESEARCH AGREEMENT

The present disclosure was made by or on behalf of the below listed parties to a joint research agreement. The joint research agreement was in effect on or before the date the present disclosure was made and the present disclosure was made as a result of activities undertaken within the scope of the joint research agreement. The parties to the joint research agreement are 1) SAMSUNG ELECTRONICS CO., LTD. and 2) INHA-INDUSTRY PARTNERSHIP INSTITUTE.

TECHNICAL FIELD

The present disclosure relates to an electronic device and a display control method thereof.

BACKGROUND

The sales volume and use of mobile devices is rapidly increasing on a global scale due to the development of mobile communication technology. Users on the move may conduct web surfing through ultra-high speed internet by using these mobile devices. Additionally, users may use these mobile devices to network with other users, and enjoy various contents through display screens.

Typically an electronic device is put in various environments having different illuminations. For example, a user may enjoy contents through an electronic device in a shop (e.g., in a cafe or a bar) where red or yellow illuminants are installed, and then move to another shop where blue illuminants are installed and continuously enjoy the contents. In this case, the user's visual sensitivity may be degraded.

The above information is presented as background information only to assist with an understanding of the present disclosure. No determination has been made, and no assertion is made, as to whether any of the above might be applicable as prior art with regard to the present disclosure.

SUMMARY

Aspects of the present disclosure are to address at least the above-mentioned problems and/or disadvantages and to provide at least the advantages described below. Accordingly, an aspect of the present disclosure is to provide an electronic device capable of providing a user with contents of image quality that is flexible to an incident light that is incident to the electronic device, and a display control method thereof.

In accordance with an aspect of the present disclosure, a display control method of an electronic device is provided. The display control method includes sensing, by the electronic device, a chromaticity and an illuminance of an incident light, calculating an optimal white of a display based on the chromaticity of the incident light, and correcting the calculated optimal white by using the illuminance of the incident light.

In accordance with another aspect of the present disclosure, an electronic device is provided. The electronic device includes an image sensor configured to sense a chromaticity and an illuminance of an incident light, and a control module configured to calculate an optimal white of a display based on the chromaticity of the incident light and to correct the calculated optimal white by using the illuminance of the incident light.

Other aspects, advantages, and salient features of the disclosure will become apparent to those skilled in the art from the following detailed description, which, taken in conjunction with the annexed drawings, discloses various embodiments of the present disclosure.

BRIEF DESCRIPTION OF THE DRAWINGS

The above and other aspects, features, and advantages of certain embodiments of the present disclosure will be more apparent from the following description taken in conjunction with the accompanying drawings, in which.

Throughout the drawings, it should be noted that like reference numbers are used to depict the same or similar elements, features, and structures.

DETAILED DESCRIPTION

Figure 1:
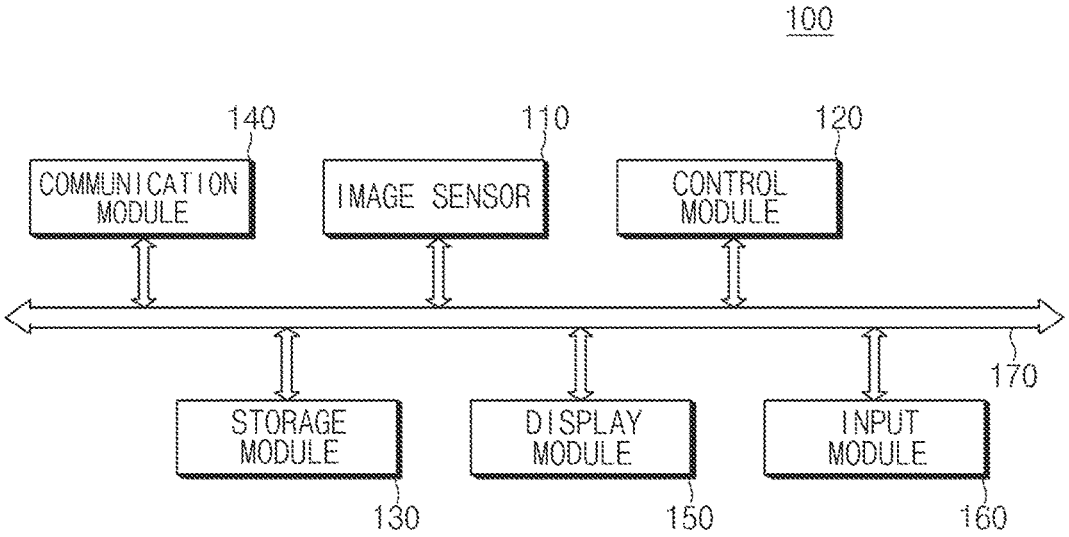
FIG. 1 is a block diagram illustrating an electronic device according to an embodiment of the present disclosure.

The following description with reference to the accompanying drawings is provided to assist in a comprehensive understanding of various embodiments of the present disclosure as defined by the claims and their equivalents. It includes various specific details to assist in that understanding but these are to be regarded as merely exemplary. Accordingly, those of ordinary skill in the art will recognize that various changes and modifications of the various embodiments described herein can be made without departing from the scope and spirit of the present disclosure. In addition, descriptions of well-known functions and constructions may be omitted for clarity and conciseness.

The terms and words used in the following description and claims are not limited to the bibliographical meanings, but, are merely used by the inventor to enable a clear and consistent understanding of the present disclosure. Accordingly, it should be apparent to those skilled in the art that the following description of various embodiments of the present disclosure is provided for illustration purpose only and not for the purpose of limiting the present disclosure as defined by the appended claims and their equivalents.

It is to be understood that the singular forms "a," "an," and "the" include plural referents unless the context clearly dictates otherwise. Thus, for example, reference to "a component surface" includes reference to one or more of such surfaces.

The terms "include," "comprise," "including," and/or "comprising" used herein indicate disclosed functions, operations, and/or existence of elements but do not exclude other functions, operations and/or elements. It will be further understood that the terms "comprises", "comprising,", "includes" and/or "including", when used herein, specify the presence of stated features, integers, steps, operations, elements, and/or components, but do not preclude the presence or addition of one or more other features, integers, steps, operations, elements, components, and/or groups thereof.

The meaning of the term "or" used herein includes any combination of the words connected by the term "or". For example, the expression "A or B" may indicate A, B, or both A and B.

The terms such as "first", "second", and the like used herein may refer to various elements of various embodiments of the present disclosure, but do not limit the elements. For example, such terms do not limit the order and/or priority of the elements. Furthermore, such terms may be used to distinguish one element from another element. For example, "a first user device" and "a second user device" indicate different user devices. For instance, without departing the scope of the present disclosure, a first element may be named as a second element, and similarly, a second element may be named as a first element.

It will be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present. Other words used to describe the relationship between elements should be interpreted in a like fashion (i.e., "between" versus "directly between", "adjacent" versus "directly adjacent", etc.).

The terminology used herein is not for delimiting the present disclosure but for describing specific embodiments. The terms of a singular form may include plural forms unless otherwise specified.

Unless otherwise defined, the terms used herein, including technical or scientific terms, have the same meanings as understood by those skilled in the art. The general terms used herein should be interpreted according to the definitions in the dictionary or in the context and should not be interpreted as an excessively contracted meaning.

An electronic device according to the present disclosure may include a communication function. For example, the electronic devices may include at least one of smartphones, tablet personal computers (PCs), mobile phones, video telephones, electronic book readers, desktop PCs, laptop PCs, network computers, personal digital assistants (PDAs), portable multimedia players (PMPs), MP3 players, mobile medical devices, cameras, wearable devices (e.g., head-mounted-devices (HMDs) such as electronic glasses), electronic apparel, electronic bracelets, electronic necklaces, electronic appcessories, electronic tattoos, and smart watches.

According to some embodiments of the present disclosure, electronic devices may be smart home appliances having communication functions. The smart home appliances may include at least one of, for example, televisions (TVs), digital versatile disk (DVD) players, audio players, refrigerators, air conditioners, cleaners, ovens, microwave ovens, washing machines, air cleaners, set-top boxes, TV boxes (e.g., Samsung HomeSync™, Apple TV™, or Google TV™), game consoles, electronic dictionaries, electronic keys, camcorders, and electronic picture frames.

According to some embodiments of the present disclosure, electronic devices may include at least one of medical devices (e.g., magnetic resonance angiography (MRA), magnetic resonance imaging (MRI), computed tomography (CT), scanners, and ultrasonic devices), navigation devices, global positioning system (GPS) receivers, event data recorders (EDRs), flight data recorders (FDRs), vehicle infotainment devices, electronic equipment for vessels (e.g., navigation systems and gyrocompasses), avionics, security devices, head units for vehicles, industrial or home robots, automatic teller's machines (ATMs), and points of sales (POSs).

According to some embodiments of the present disclosure, electronic devices may include at least one of parts of furniture or buildings/structures having communication functions, electronic boards, electronic signature receiving devices, projectors, and measuring instruments (e.g., water meters, electricity meters, gas meters, and wave meters). Electronic devices according to the present disclosure may be one or more combinations of the above-mentioned devices. Furthermore, electronic devices according to the present disclosure may be flexible devices. In addition, it would be obvious to those skilled in the art that electronic devices according to the present disclosure are not limited to the above-mentioned devices.

Hereinafter, electronic devices according to various embodiments of the present disclosure will be described with reference to the accompanying drawings. The term "user" used herein may refer to a person who uses an electronic device or may refer to a device (e.g., an artificial electronic device) that uses an electronic device.

Optimal white described herein may mean, for example, white that is set for a screen of an electronic device to have optimal image quality under an effect of an incident light. In addition, optimal white according to an aspect may mean white that is set to minimize an effect of an incident light on a screen of an electronic device. Optimal white according to another aspect of the present disclosure may also mean white that is set for a screen of an electronic device, on which an effect of an incident light is minimized, to be output to a user. In addition, optimal white described in various embodiments of the present disclosure may be understood as a concept including an RGB grayscale value for representing white.

FIGS. 1 through 11, discussed below, and the various embodiments used to describe the principles of the present disclosure in this patent document are by way of illustration only and should not be construed in any way that would limit the scope of the disclosure. Those skilled in the art will understand that the principles of the present disclosure may be implemented in any suitably arranged communications system. The terms used to describe various embodiments are exemplary. It should be understood that these are provided to merely aid the understanding of the description, and that their use and definitions in no way limit the scope of the present disclosure. Terms first, second, and the like are used to differentiate between objects having the same terminology and are in no way intended to represent a chronological order, unless where explicitly stated otherwise. A set is defined as a non-empty set including at least one element.

Figure 2:
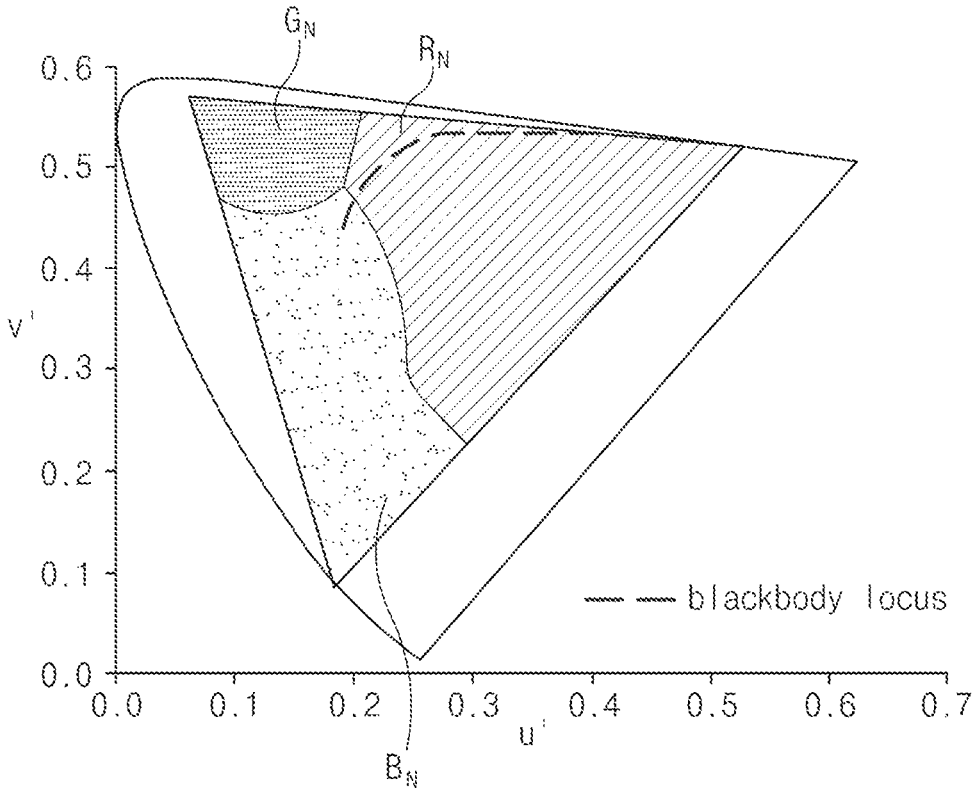
FIG. 2 illustrates color coordinates of an incident light irradiated on an electronic device according to an embodiment of the present disclosure.
Figure 3:
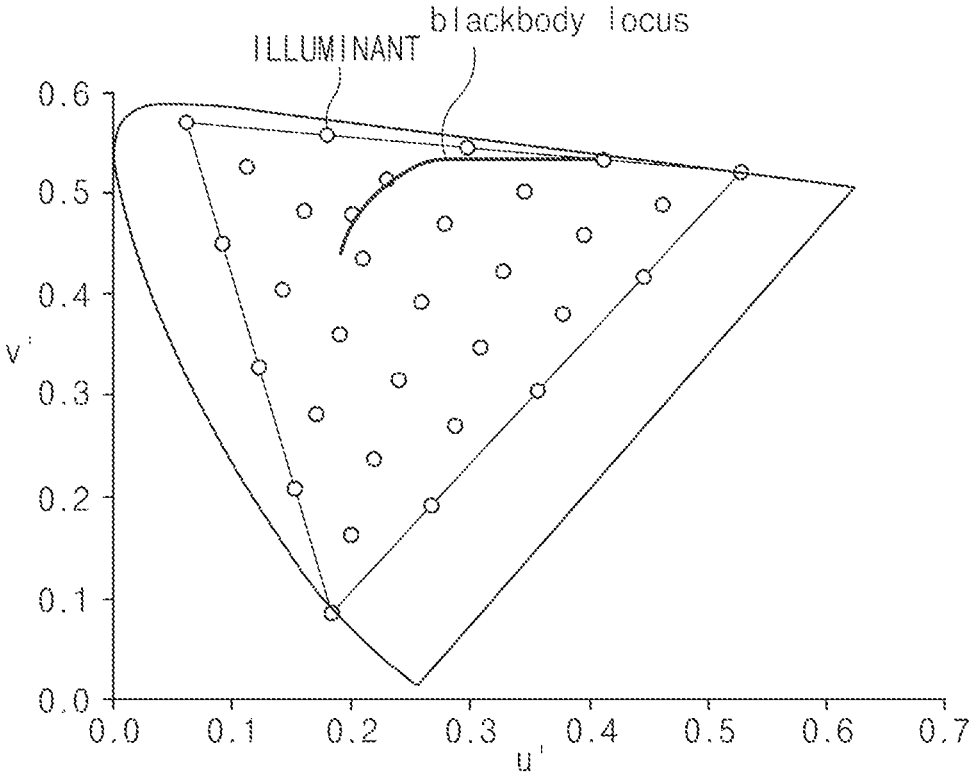
FIG. 3 illustrates color coordinates of lights of illuminants, wherein the lights are irradiated on an electronic device according to an embodiment of the present disclosure.
Figure 4:
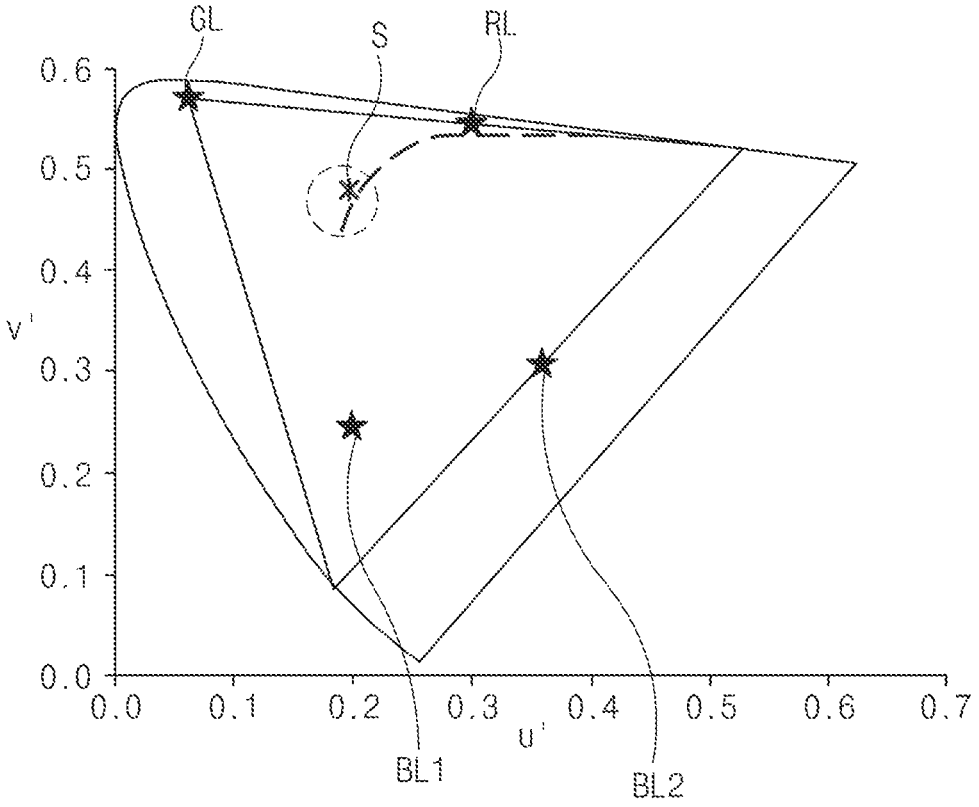
FIG. 4 schematically illustrates optimal white calculated under a first reference illuminance and a second reference illuminance according to an embodiment of the present disclosure.
Figure 5:
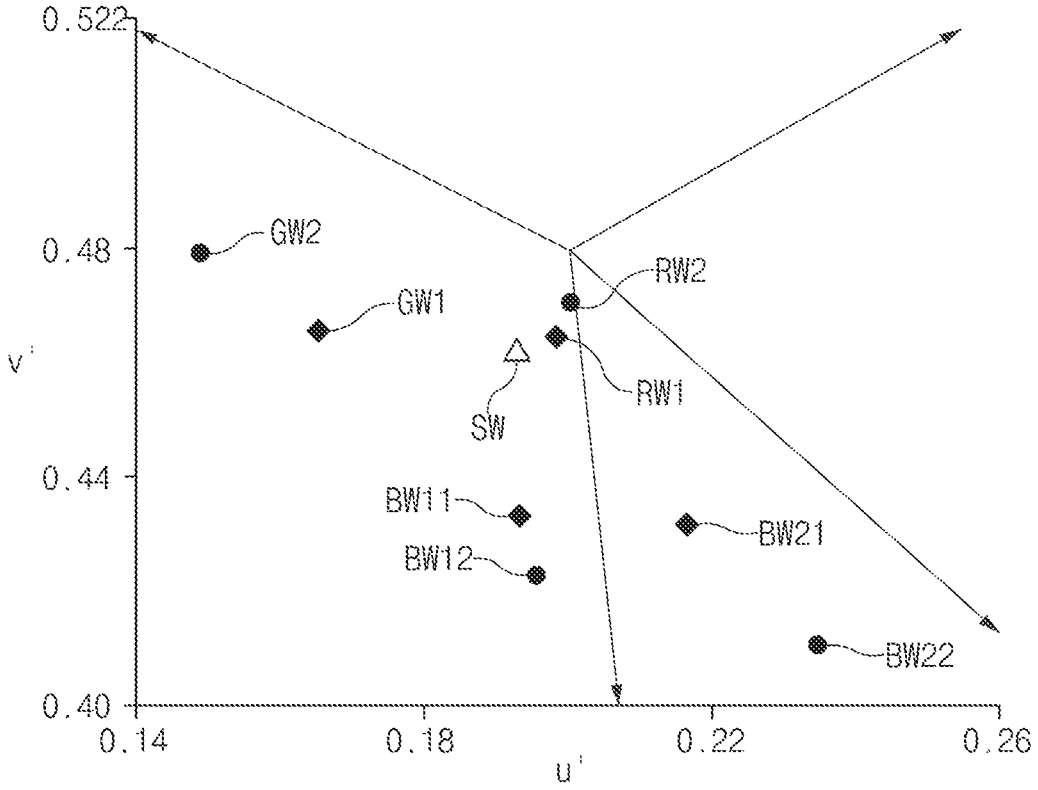
FIG. 5 schematically illustrates optimal white calculated under a first reference illuminance and a second reference illuminance according to an embodiment of the present disclosure.
Figure 6:
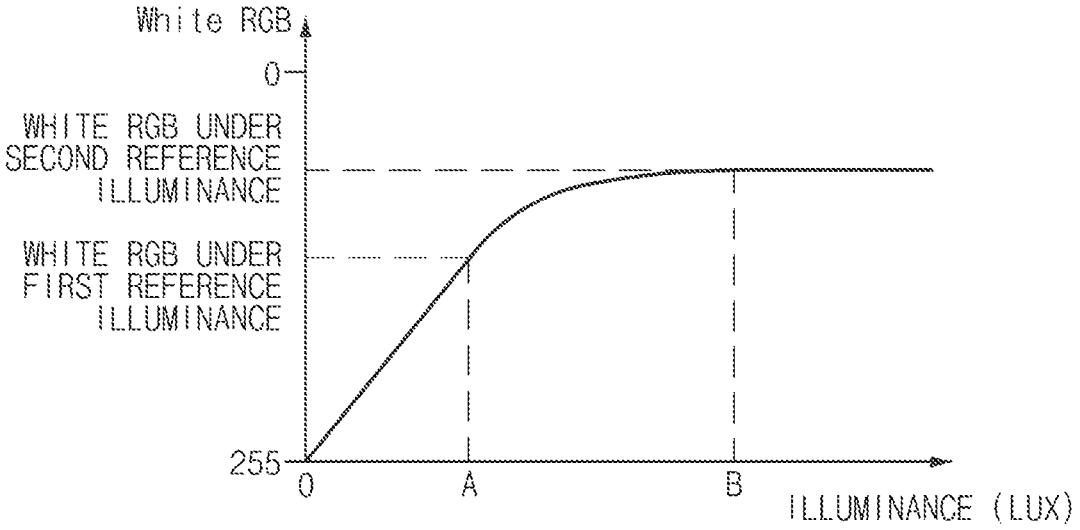
FIG. 6 illustrates a graph for explaining an optimal white correction process of an electronic device according to an embodiment of the present disclosure.

FIG. 1 is a block diagram illustrating an electronic device according to an embodiment of the present disclosure. FIG. 2 illustrates color coordinates of an incident light irradiated on an electronic device according to an embodiment of the present disclosure. FIG. 3 illustrates color coordinates of lights of illuminants, wherein the lights are irradiated on an electronic device according to an embodiment of the present disclosure. FIGS. 4 and 5 schematically illustrate optimal white calculated under a first reference illuminance and a second reference illuminance according to various embodiments of the present disclosure. FIG. 6 illustrates a graph for explaining an optimal white correction process of an electronic device according to an embodiment of the present disclosure.

Referring to FIG. 1, an electronic device 100 is illustrated, where the electronic device 100 includes an image sensor 110, a control module 120, a storage module 130, a communication module 140, a display module 150, and an input module 160. For example, the image sensor 110, the control module 120, the storage module 130, the communication module 140, the display module 150, and the input module 160 may be connected to each other through a bus 170.

The image sensor 110 may sense chromaticity and illuminance of an incident light. For example, when the image sensor 110 is positioned in a same direction as that of the display module 150 of the electronic device 100, the incident light may include an illuminant light of an illuminant, wherein the illuminant light is irradiated on the display module 150. For example, the image sensor 110 and the display module 150 may be all disposed on the front surface of the electronic device 100. In this case, the control module 120 may sense chromaticity and illuminance of the incident light based on the incident light (e.g., the illuminant light) that is incident towards the display module 150 (e.g., a display) of the electronic device 100.

In another example, when the image sensor 110 is located in a different direction (e.g., an opposite direction) from that of the display module 150 of the electronic device 100, the incident light may include a reflection light that is reflected by another object or an obstacle, and is incident. For example, when the image sensor 110 is located on the front surface of the electronic device 100 and the display module 150 is located on the rear surface of the electronic device 100, the incident light may include a light irradiated from a direction at which the user looks, namely, a reflection light that is reflected by an object such as the ground or a wall. In other words, in various embodiments of the present disclosure, the electronic device 100 may sense chromaticity and illuminance of the incident light based on a relative arrangement of the image sensor 110 and the display module 150, and calculate and correct the optimal white from the chromaticity and illuminance.

Hereinafter, for convenience of explanation, it is assumed that an incident light is a light irradiated from an illuminant or a reflection light, which is light reflected by an object such as the ground or a wall. The chromaticity may be defined by using at least one selected from among grayscale values of red (R), green (G), and blue (B). The illuminance may be calculated by using the sensed R, G, and B values.

The control module 120 may calculate the optimal white based on the chromaticity of the incident light. The control module 120 may calculate the optimal white under first reference illuminance A and second reference illuminance B. For example, the first reference illuminance A may be defined lower than the second reference illuminance B. Specifically, the control module 120 may classify a color type of the incident light, set any one of the sensed R, G, and B values as a maximal grayscale value (e.g., 255) based on the classified color type, and calculate grayscale values at optimal white of the remains of the R, G, and B values, which are not set as the maximal grayscale value.

First, the control module 120 may normalize each grayscale value of the R, G, and B values of the incident light. Specifically, the control module 120 may normalize by respectively dividing grayscale values of R, G, and B of the incident light by R, G, and B grayscale values of a reference illuminant. This may be defined as Equation 1. For example, the reference illuminant may be assumed as an illuminant of which R, G, and B grayscale values of the optimal white are all 255.

$$R_N = R_{sensor}/R_{standard} \quad \text{Equation 1}$$

In Equation 1 $R_N$ denotes a normalized R grayscale value, $R_{sensor}$ denotes an R grayscale value of the incident light, and $R_{standard}$ may mean an R grayscale value in the reference illuminant. The control module 120 may normalize each of G and B grayscale values of the incident light in the same manner as Equation 1.

The control module 120 may set a grayscale value (e.g., $R_N$) having the greatest value among the normalized $R_N$, $G_N$, and $B_N$ as a maximal grayscale value. The maximum grayscale value may be, for example, 255.

Referring to FIG. 2, regions $R_N$, $G_N$, and $B_N$ are illustrated according to color coordinates of the incident light, where the regions are respectively at a maximum. The control module 120 may calculate the optimal white even when the color coordinates of the incident light are not located on a blackbody locus.

Referring to FIG. 1 again, the control module 120 may calculate grayscale values in the optimal white for the remaining colors (e.g., G and B) excluding a color selected to have the maximum grayscale value. For example, the control module 120 may calculate grayscale values in the optimal white for the remaining colors (e.g., G and B) through Equations 2 and 3.

$$G_{Display} = a_{RG1}*r^2 + a_{RG2}*g^2 + a_{RG3}*r + a_{RG4}*g + a_{RG5}*rg + a_{RG6} \quad \text{Equation 2}$$

$$B_{Display} = a_{RB1}*r^2 + a_{RB2}*b^2 + a_{RB3}*r + a_{RB4}*b + a_{RB5}*rb + a_{RB6} \quad \text{Equation 3}$$

In Equations 2 and 3, $G_{Display}$ denotes a G grayscale value with the optimal white balance, $B_{Display}$ denotes a B grayscale value with the optimal white, $a_{RBi}$ and $a_{RGi}$ denote determination coefficients, and r, g, and b denote respectively normalized values in a range from 0 to 1 for R, G, and B grayscale values of the incident light.

Furthermore, in Equations 2 and 3, a case where $R_N$ is the maximum is exemplarily described. However, the control module 120 may calculate grayscale values with the optimal white in the same manner as Equations 2 and 3, even when $G_N$ or $B_N$ is the maximum. For example, when $G_N$ is the maximum, the control module 120 may respectively calculate $R_{Display}$ and $B_{Display}$ using Equations 4 and 5.

$$R_{Display}=a_{GR1}*g^2+a_{GR2}*r^2+a_{GR3}*g+a_{GR4}*r+a_{GR5}*gr+a_{GR6} \quad \text{Equation 4}$$

$$B_{Display}=a_{GB1}*g^2+a_{GB2}*b^2+a_{GB3}*g+a_{GB4}*b+a_{GB5}*gb+a_{GB6} \quad \text{Equation 5}$$

In Equations 4 and 5 $R_{Display}$ denotes R grayscale value with the optimal white, $B_{Display}$ denotes B grayscale value with the optimal white, $a_{GRi}$ and $a_{GBi}$ denote determination coefficients, and r, g, and b denote respectively normalized values in a range from 0 to 1 for R, G, and B grayscale values of the incident light.

When $B_N$ is the maximum, the control module 120 may respectively calculate $R_{Display}$ and $G_{Display}$ using Equations 6 and 7.

$$R_{Display}=a_{BR1}*b^2+a_{BR2}*r^2+a_{BR3}*b+a_{BR4}*r+a_{BR5}*br+a_{BR6} \quad \text{Equation 6}$$

$$G_{Display}=a_{BG1}*b^2+a_{BG2}*g^2+a_{BG3}*b+a_{BG4}*g+a_{BG5}*bg+a_{BG6} \quad \text{Equation 7}$$

In Equations 6 and 7 $R_{Display}$ denotes R grayscale value with the optimal white, $G_{Display}$ denotes G grayscale value with the optimal white, $a_{BRi}$ and $a_{BGi}$ denote determination coefficients, and r, g, and b denote respectively normalized values in a range from 0 to 1 for R, G, and B grayscale values of the incident light.

r, g, and b used in Equations 2 to 7 may be defined as using Equations 8 and 9.

$$r=R_{sensor}/(R_{sensor}+G_{sensor}+B_{sensor})$$
$$g=G_{sensor}/(G_{sensor}+G_{sensor}+B_{sensor})$$
$$b=B_{sensor}/(R_{sensor}+G_{sensor}+B_{sensor}) \quad \text{Equation 8}$$

$$r+g+b=1 \quad \text{Equation 9}$$

The control module 120 may calculate the determination coefficients ($a_{RGi}$, $a_{RBi}$, $a_{GRi}$, $a_{GBi}$, $a_{BRi}$ and $a_{BGi}$) used in Equations 2 to 7 by using a regression method.

Specifically, the determination coefficients ($a_{RGi}$, $a_{RBi}$, $a_{GRi}$, $a_{GBi}$, $a_{BRi}$ and $a_{BGi}$) may be calculated using Equations 10 to 19. In Equations 10 to 19, a procedure of calculating a G grayscale value is exemplarily described when $R_N$ is the maximum. However, it may be well understood that the procedure may be also applied in an identical manner, even in a case where $G_N$ or $B_N$ is the maximum.

Equation 10

$$\begin{aligned} G_1 &= a_{RG1}*r_1^2+a_{RG2}*g_1^2+a_{RG3}*r_1+a_{RG4}*g_1+a_{RG5}*r_1g_1+a_{RG6} \\ G_2 &= a_{RG1}*r_2^2+a_{RG2}*g_2^2+a_{RG3}*r_2+a_{RG4}*g_2+a_{RG5}*r_2g_2+a_{RG6} \\ &\cdots \\ Gn &= a_{RG1}*r_n^2+a_{RG2}*g_n^2+a_{RG3}*r_n+a_{RG4}*g_n+a_{RG5}*r_ng_n+a_{RG6} \end{aligned}$$

In Equation 10 $G_i$ denotes a G grayscale value with the optimal white for n illuminants (where n is a natural number) each $R_N$ of which is the maximum. $r_i$, $g_i$, and $b_i$ (where i is a natural number) denote respectively normalized values in a range from 0 to 1 for R, G, and B grayscale values of the incident light of the n illuminants.

Equation 10 may be represented as Equation 11 by using a matrix. In order to calculate the determination coefficient $a_{RGi}$ in Equation 11, G grayscale values may be used which are experimentally determined with the optimal white for n illuminants (where n is a natural number) each $R_N$ of which is the maximum.

Specifically, the experimentally determined G grayscale values may be determined through the following procedure. At least one illuminant whose $R_N$ is the maximum among the illuminants illustrated in FIG. 3 is selected, a subject is allowed to adapt to the selected illuminant for a predetermined time, white of an image displayed on the display module 150 of the electronic device 100 is varied, and white that the subject visually recognizes as the optimal image quality is determined as the optimal white. In addition, G grayscale values at that time may be used as G grayscale values ($G_{testn}$, where n is a natural number) in Equation 11.

$$\begin{bmatrix} G_{test1} \\ G_{test2} \\ \cdots \\ G_{testn} \end{bmatrix} = \begin{bmatrix} r_1^2 & g_1^2 & r_1 & g_1 & r_1g_1 & 1 \\ r_2^2 & g_2^2 & r_2 & g_2 & r_2g_2 & 1 \\ \cdots & \cdots & \cdots & \cdots & \cdots & \cdots \\ r_n^2 & g_n^2 & r_n & g_n & r_ng_n & 1 \end{bmatrix} \begin{bmatrix} a_{RG1} \\ a_{RG2} \\ a_{RG3} \\ a_{RG4} \\ a_{RG5} \\ a_{RG6} \end{bmatrix} \quad \text{Equation 11}$$

In Equation 11 $G_{testn}$ may mean a G grayscale value with the optimal white experimentally determined. A value of $G_{testn}$ (wherein, n is a natural number) may be stored in the storage module 130 in advance. Equation 11 may be defined using Equation 12.

$$P=\begin{bmatrix} G_{test1} \\ G_{test2} \\ \cdots \\ G_{testn} \end{bmatrix}, V=\begin{bmatrix} r_1^2 & g_1^2 & r_1 & g_1 & r_1g_1 & 1 \\ r_2^2 & g_2^2 & r_2 & g_2 & r_2g_2 & 1 \\ \cdots & \cdots & \cdots & \cdots & \cdots & \cdots \\ r_n^2 & g_n^2 & r_n & g_n & r_ng_n & 1 \end{bmatrix}, A=\begin{bmatrix} a_{RG1} \\ a_{RG2} \\ a_{RG3} \\ a_{RG4} \\ a_{RG5} \\ a_{RG6} \end{bmatrix} \quad \text{Equation 12}$$

In other words, P=VA is established through Equations 11 and 12, and Equation 13 may be defined as the following in consideration of an error e. The error e may mean an error between the G grayscale values $G_{testn}$ experimentally determined and G grayscale values $G_n$ calculated through Equation 10.

$$VA=P+e$$
$$e=VA-P$$
$$ee'=(VA-P)(VA+P)' \quad \text{Equation 13}$$

In order to minimize the error e in Equation 13, both sides differentiated with respect to V and A that allows the differentiated result to be 0 may be calculated using Equation 14.

$$\frac{\partial}{\partial A}ee'=\frac{\partial}{\partial A}(VA-P)(VA-P)'=0 \quad \text{Equation 14}$$

V and A satisfying Equation 14 may be defined using Equation 15.

$$VV'A=VP \quad \text{Equation 15}$$

Accordingly, A may be calculated using Equation 16.

$$A=(VV')^{-1}VP \quad \text{Equation 16}$$

Through the above-described procedure, the control module 120 may classify the incident light according to a color type, and calculate grayscale values of R, G, and B with the optimal white under the first reference illuminance A and the second reference illuminance B according to the classified color type.

Hereinafter, a description is made regarding the optimal white calculated in the first reference illuminance A and the second reference illuminance B with reference to FIGS. 4 and 5.

As mentioned above, FIGS. 4 and 5 schematically illustrate optimal white calculated under a first reference illuminance and a second reference illuminance according to various embodiments of the present disclosure.

Referring to FIG. 4, S may represent color coordinates of a reference illuminant. GL may represent G type color coordinate of the incident light. RL may represent R type color coordinate of the incident light. BL1 and BL2 may respectively represent B type color coordinates of the incident light.

FIG. 5 is an enlarged view of a dashed line portion of FIG. 4, illustrating color coordinates of optimal white under a first reference illuminance A and a second reference illuminance B according to chromaticity of the incident light. SW may mean the optimal white with respect to the reference light. For example, optimal white for GL under the first reference illuminance A may be calculated as GW1. Optimal white for GL under the second illuminance B may be calculated as GW2. In addition, optimal white for RL under the first reference illuminance A may be calculated as RW1, and optimal white for RL under the second reference illuminance B may be calculated as RW2. Furthermore, optimal white for BL1 under the first reference illuminance A may be calculated as BW11, and optimal white for BL1 under the second reference illuminance B may be calculated as BW12. Furthermore, optimal white for BL2 under the first reference illuminance A may be calculated as BW21, and optimal white for BL2 under the second reference illuminance B may be calculated as BW22.

In other words, from a view of color coordinates, optimal white based on chromaticity of the incident light may be shifted in a direction close to color coordinates of the incident light from color coordinates of the reference light. In addition, the optimal white calculated under the second reference illuminance B may be set closer to the color coordinates of the incident light than the optimal white calculated under the first reference illuminance A.

Referring to FIGS. 1 and 6, the control module 120 may correct the optimal white calculated by using an illuminance of incident light. Specifically, the control module 120 may correct the optimal white calculated through Equations 1 to 16 by using the illuminance of the incident light.

For example, the control module 120 may correct the optimal white by linearly interpolating an optimal white calculated when the illuminance of the incident light is lower than the first reference illuminance A between the RGB grayscale value of the optimal white and a maximal grayscale value (i.e., 255). For example, when the illuminance of the incident light is not smaller than the first reference illuminance A and not greater than the second illuminance B, the control module 120 may interpolate and correct the calculated optimal white. The control module 120 may interpolate and correct the calculate optimal white by using a logarithmic function between an RGB grayscale value of the optimal white under the first illuminance A and an RGB grayscale value of the optimal white under the second illuminance B. For example, when the illuminance of the incident light is greater than the second illuminance B, the control module 120 may select the RGB grayscale value of the optimal white calculated under the second reference illuminance B.

The storage module 130 may store RGB grayscale values of experimentally determined optimal white. For example, the RGB grayscale values stored in the storage module 130 may be used to calculate Equation 11. The storage module 130 may include, for example, at least any one type of storage medium including a memory such as a flash memory type, a hard disk type, a micro type, and a card type (for example, a Secure Digital (SD) Card or an eXtream Digital (XD) Card), and a memory such as a Random Access Memory (RAM), a Static RAM (SRAM), a Read-Only Memory (ROM), a Programmable ROM (PROM), an Electrically Erasable PROM (EEPROM), a Magnetic RAM (MRAM), a magnetic disk, and an optical disk type.

The communication module 140 may receive RGB grayscale values of the experimentally determined optimal white by communicating with the outside (e.g., a server).

In other words, the RGB grayscale values of the experimentally determined optimal white are stored in the storage module 130 of the electronic device 100 and loaded on the control module 120, or stored in the outside (e.g., a server) and loaded on the control module 120 through the communication module 140.

The display module 150 may display content in response to a request by a user. The display module 150 may display content according to the optimal white that is set by a control of the control module 120. For example, the display module 150 may include at least one selected from a Liquid Crystal Display (LCD), a Thin Film Transistor-LCD (TFT-LCD), a Light Emitting Diode (LED), an Organic LED (OLED), an Active Matrix OLED (AMOLED), a flexible display, a bended display, and a 3D display. A part of the forgoing displays may be realized with a transparent display formed of transparent type or optical transparent type in order to allow a user to see the outside through. Furthermore, the display module 150 may be prepared as a touch screen including a touch panel and include a function of the input module 160.

The input module 160 may receive a command for setting the optimal white from a user. For example, when chromaticity of an incident light is varied according to movement of the user, the user may newly set the optimal white. When the user inputs a command for re-setting the optimal white through the input module 160, the control module 120 may calculate the optimal white based on the chromaticity of the incident light sensed by an image sensor 110 and correct the calculated optimal white by using illuminance of the incident light.

As described above, the electronic device according to various embodiments of the present disclosure may calculate an optimal white based on chromaticity of an incident light and correct the calculated optimal white. Specifically, the control module 120 of the electronic device 100 may calculate the optimal white under the first reference illuminance A and the second illuminance B based on the chromaticity of the incident light. The control module 120 may compare the illuminance of the incident light with the first reference illuminance A and the second reference illuminance B and correct the calculated optimal white. Accordingly, the electronic device 100 according to various embodiments of the present disclosure may provide a user with content of optimal image quality regardless of the incident light. Furthermore, even though the incident light is not located on a blackbody locus in a space where the incident light is defined with color coordinates, the electronic device 100 according to various embodiments of the present disclosure may possibly calculate the optimal white and the optimal white may be calculated in various illuminant environments.

Figure 7:
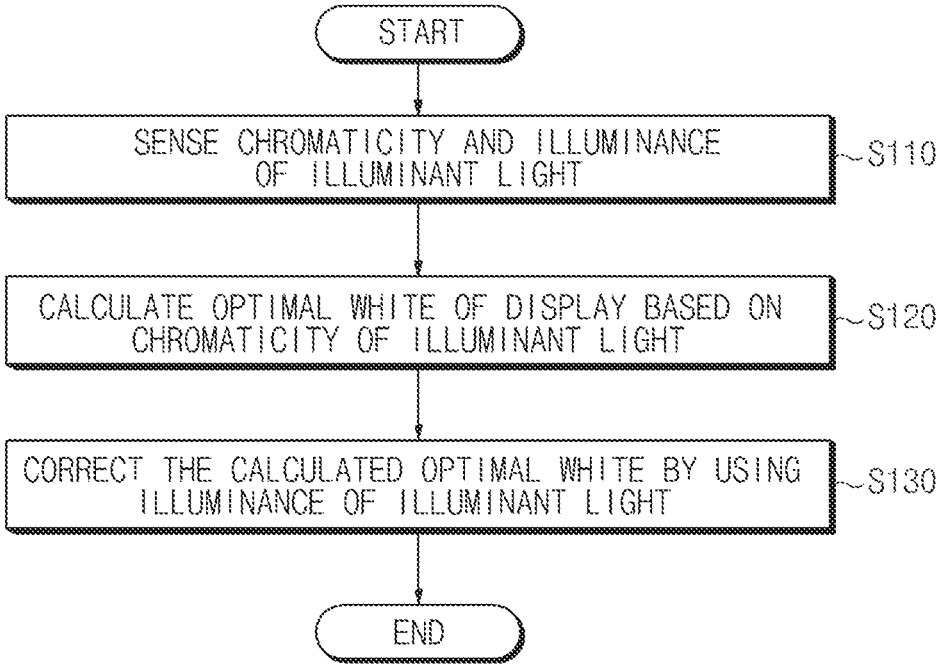
FIG. 7 is a flowchart illustrating a display control method of an electronic device according to an embodiment of the present disclosure.
Figure 8:
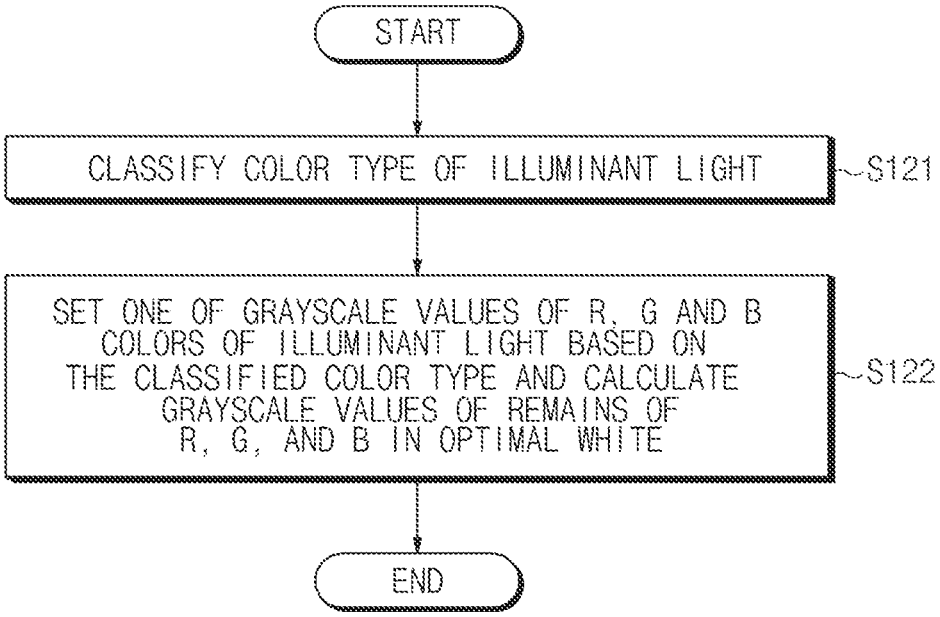
FIG. 8 is a flowchart illustrating a display control method of an electronic device according to an embodiment of the present disclosure.

FIG. 7 is a flowchart illustrating a display control method of an electronic device according to an embodiment of the present disclosure. FIG. 8 is a flowchart illustrating a display control method of an electronic device according to an embodiment of the present disclosure.

It will be well understood that an illuminant light is exemplified as an incident light in FIGS. 7 and 8, but is not limited hereto.

Referring to FIG. 7, a display control method of an electronic device according to an embodiment of the present disclosure may include sensing, in operation S110, chromaticity and illuminance of an incident (e.g., illuminant) light, calculating, in operation S120, an optimal white of a display based on the chromaticity of the incident (e.g., illuminant) light, and correcting, in operation S130, the calculated optimal white by using the illuminance of the incident (e.g., illuminant) light.

Hereinafter, a description about operations S110 to S130 is provided with reference to FIGS. 1 to 6.

In operation S110, the image sensor 110 may sense the chromaticity and illuminance of the incident light. For example, the chromaticity may be defined by using at least one of R, G, and B grayscale values. The illuminance may be calculated by using the sensed R, G, and B grayscale values.

In operation S120, the control module 120 may calculate optimal white under the first reference illuminance A and the second reference illuminance B based on the chromaticity of the incident light. Specifically, the control module 120 may calculate the optimal white under each of the first reference illuminance A and the second reference illuminance B by using the above-described Equations 1 to 16.

Referring to FIG. 8, operation S120 may include classifying, in operation S121, a color type of the incident (e.g., illuminant) light, and setting, in operation S122, any one grayscale value of R, G, and B colors of illuminant light as a maximal grayscale value based on the classified color type, and calculating grayscale values of the remains of R, G, and B in the optimal white.

In operation S121, the control module 120 may normalize R, G, and B grayscale values of the incident light and classify the color type of the incident light. For example, the control module 120 may normalize the R, G and B grayscale values of the incident light by using Equation 1. For example, the control module 120 may determine the color type of the incident light based on a maximal value of the normalized R, G, and B grayscale values.

In operation S122, the control module 120 may set any one grayscale value of R, G, and B colors of the illuminant light as the maximal grayscale value based on the classified color type and calculate grayscale values of the remains of R, G and B in the optimal white by using Equations 2 to 16.

Referring to FIG. 7 again, in operation S130, the control module 120 may correct the calculated optimal white by using the illuminance of the incident light. Specifically, when the illuminance of the incident light is lower than the first reference illuminance A, the control module 120 may linearly interpolate the calculated optimal white between an RGB grayscale value of the optimal white under the first reference illuminance A and the maximal grayscale value (i.e., 255). For example, when the illuminance of the incident light is not smaller than the first reference illuminance A and not greater than the second reference illuminance B, the control module 120 may correct the optimal white calculated by interpolating between the RGB grayscale value of the optimal white under the first reference illuminance A and the RGB grayscale value of the optimal white under the second reference illuminance B by using a logarithmic function. For example, when the illuminance of the incident light is greater than the second reference illuminance B, the control module 120 may select the RGB grayscale value of the optimal white calculated under the second reference illuminance B.

Figure 9:
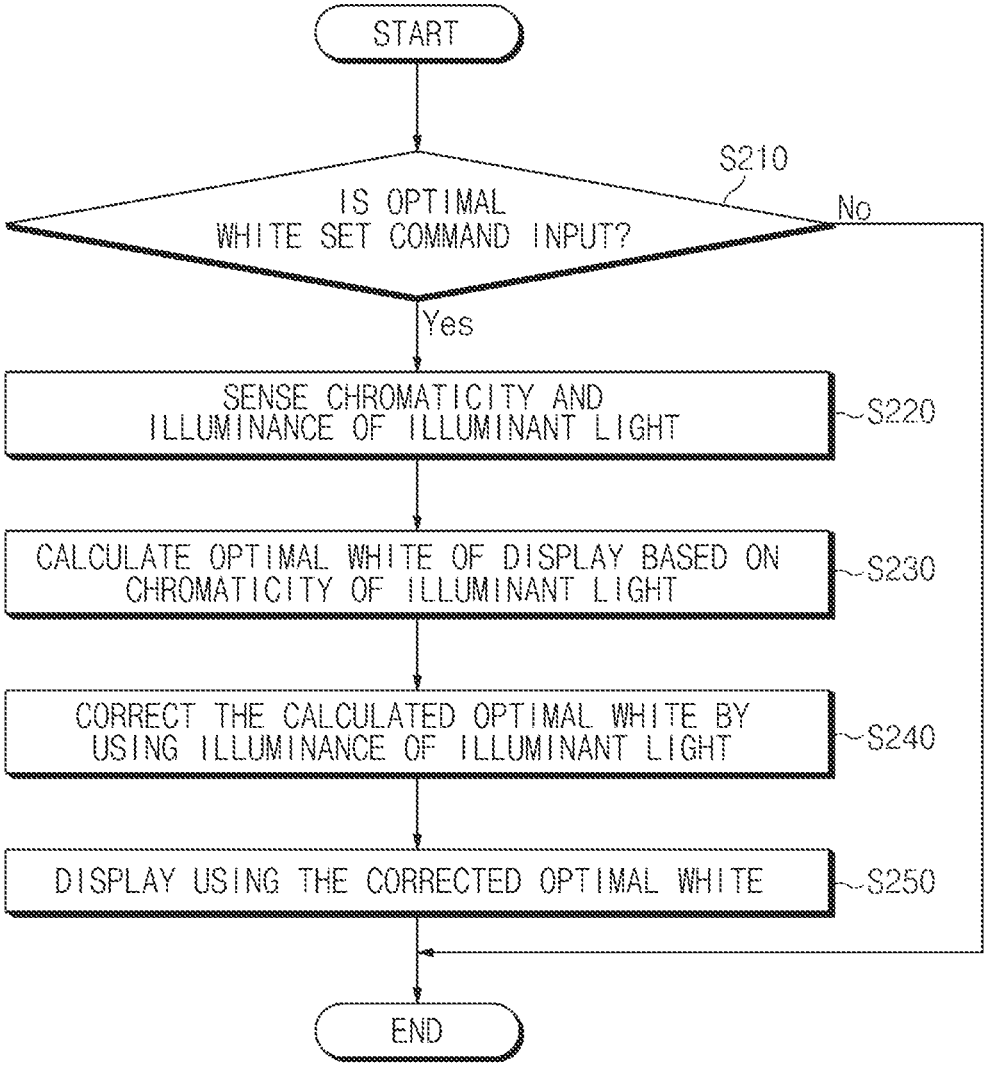
FIG. 9 is a flowchart illustrating a display control method of an electronic device according to an embodiment of the present disclosure.

FIG. 9 is a flowchart illustrating a display control method of an electronic device according to an embodiment of the present disclosure.

Referring to FIG. 9, an illuminant light is exemplified as an incident light, but is not limited hereto.

Additionally, referring to FIG. 9, a difference from FIG. 7 is mainly described in order to avoid repetitive description.

Furthermore, referring to FIG. 9, a display control method of an electronic device may include determining, in operation S210, whether an optimal white setting command is input, sensing, in operation S220, chromaticity and illuminance of the illuminant light, calculating, in operation S230, an optimal white of the display based on the chromaticity of the illuminant light, correcting, in operation S240, the calculated optimal white by using the illuminance of the light, and displaying, in operation S250, using the corrected optimal white.

Operations S220 to S240 may correspond to operations S110 to S130 described in relation to FIG. 7, respectively.

In operation S210, the control module 120 may determine whether an optimal white setting command is input from a user through the input module 160. For example, when the optimal white setting command is input from the user, operation S220 may be performed. Further, when the optimal white setting command is not input from the user, the display control method illustrated in FIG. 9 ends.

In operation S250, the display module 150 may display content according to optimal white that is set according to a control of the control module 120.

Figure 10:
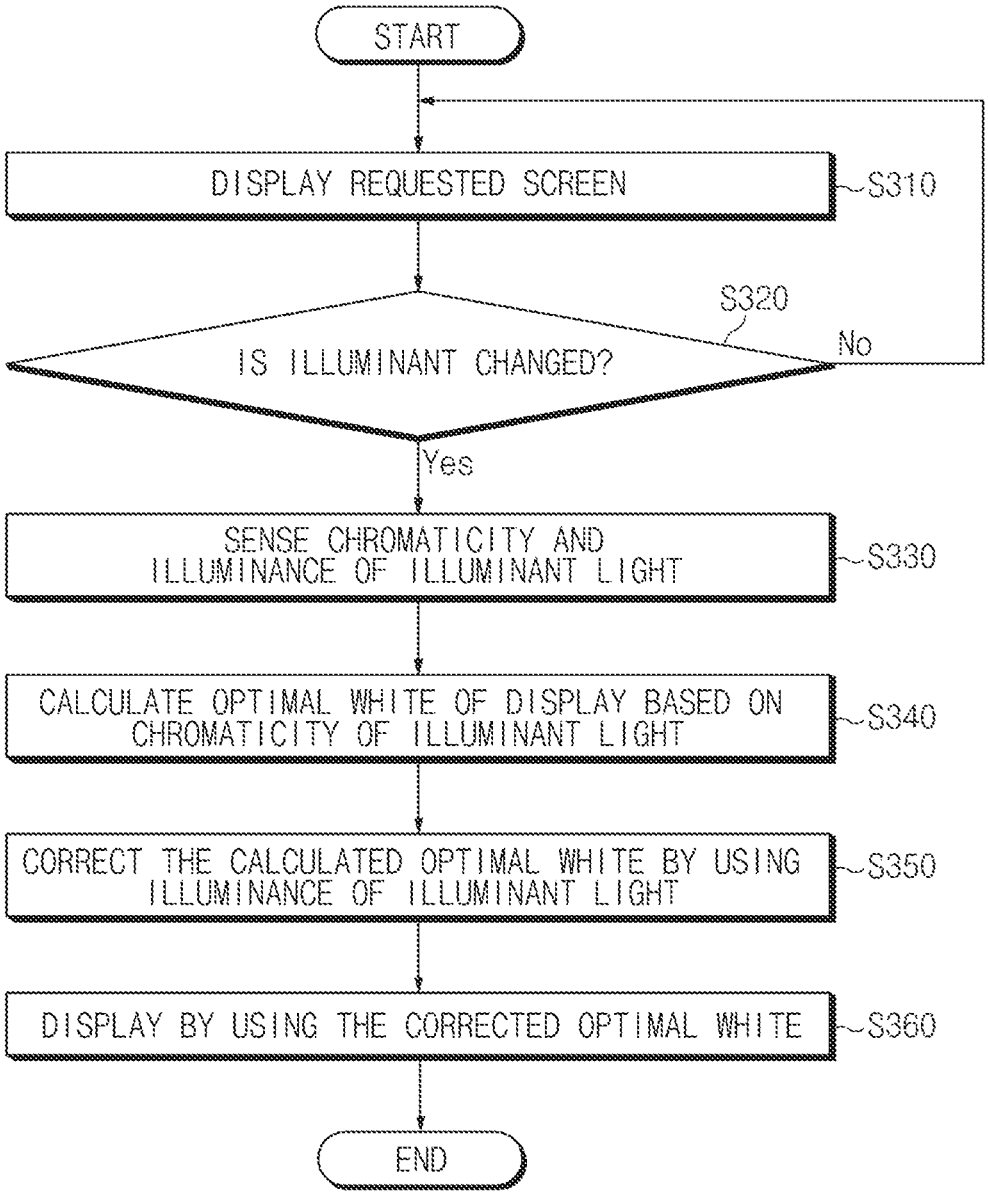
FIG. 10 is a flowchart illustrating a display control method of an electronic device according to an embodiment of the present disclosure.

FIG. 10 is a flowchart illustrating a display control method of an electronic device according to an embodiment of the present disclosure.

Referring to FIG. 10, an illuminant light is exemplified as an incident light, but is not limited hereto.

Additionally, referring to FIG. 10, a difference from FIG. 7 is mainly described in order to avoid repetitive description.

Moreover, referring to FIG. 10, a display control method of an electronic device may include displaying, in operation S310, a requested screen, sensing, in operation S320, a change of the illuminant light (e.g., sensing whether the illuminant has changed), sensing, in operation S330, chromaticity and illuminance of the illuminant light, calculating, in operation S340, an optimal white of the display based on the chromaticity of the illuminant light, correcting, in operation S350, the calculated optimal white by using the illuminance of the illuminant light, and displaying, in operation S360, by using the corrected optimal white.

Operations S330 to S360 may correspond to operations S220 to S250 described in relation to FIG. 7, respectively.

In operation S310, the display module 150 may display content requested by the user according to a preset optimal white.

In operation S320, the image sensor 110 may sense a change of the illuminant light. For example, the image sensor 110 may sense at least one change of chromaticity and illuminance of the illuminant light. When the at least one of the chromaticity and illuminance of the illuminant light is changed, operations S330 to S360 may be performed. In contrast, when the at least one of the chromaticity and illuminance of the illuminant light is not changed, operation S310 is performed.

Figure 11:
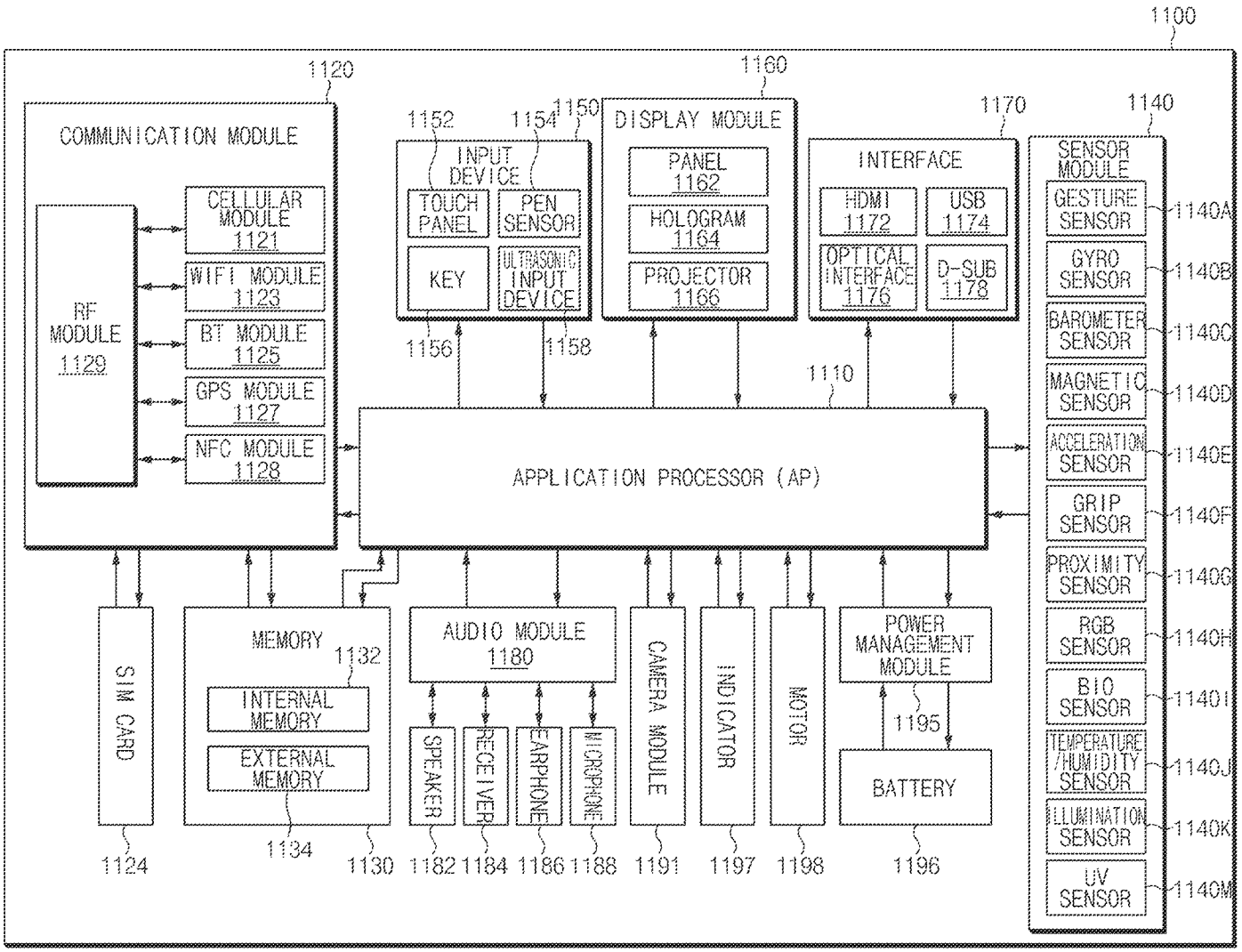
FIG. 11 is a block diagram illustrating an electronic device according to an embodiment of the present disclosure.

FIG. 11 is a block diagram illustrating an electronic device according to an embodiment of the present disclosure.

Referring to FIG. 11, an electronic device 1100 may form an entirety of or a part of an electronic device 100 illustrated in FIG. 1.

Referring to FIG. 11, the electronic device 1100 may include one or more application processors (APs) 1110, a communication module 1120, a subscriber identification module (SIM) card 1124, a memory 1130, a sensor module 1140, an input device 1150, a display module 1160, an interface 1170, an audio module 1180, a camera module 1191, a power management module 1195, a battery 1196, an indicator 1197, and a motor 1198.

The AP 1110 may run an operating system or an application program so as to control a plurality of hardware or software elements connected to the AP 1110, may process various data including multimedia data and may perform an operation. The AP 1110 may be implemented with, for example, a system on chip (SoC). According to an embodiment of the present disclosure, the AP 1110 may further include a graphic processing unit (GPU, not illustrated).

The communication module 1120 (e.g., the communication module 110) may perform data transmission/reception for communication between the electronic device 1100 (e.g., the electronic device 100) and another electronic device (e.g., another electronic device or any server) connected thereto through a network. According to an embodiment of the present disclosure, the communication module 1120 may include a cellular module 1121, a WiFi module 1123, a Bluetooth (BT) module 1125, a global positioning satellite (GPS) module 1127, a near field communication (NFC) module 1128, and a radio frequency (RF) module 1129.

The cellular module 1121 may provide a voice call service, a video call service, a text message service, or an Internet service through a telecommunications network (e.g., Long Term Evolution (LTE), LTE Advanced (LTE-A), Code Division Multiple Access (CDMA), Wideband CDMA (WCDMA), Universal Mobile Telecommunications System (UMTS), Wireless Broadband (WiBro) or Global System for Mobile Communications (GSM) network). Furthermore, the cellular module 1121 may identify and authenticate electronic devices in the telecommunications network using, for example, a subscriber identification module (e.g., the SIM card 1124). According to an embodiment of the present disclosure, the cellular module 1121 may perform at least a part of functions provided by the AP 1110. For example, the cellular module 1121 may perform at least a part of a multimedia control function.

According to various embodiments of the present disclosure, the cellular module 1121 may include a communication processor (CP). The cellular module 1121 may be implemented with, for example, an SoC. Although FIG. 11 illustrates that the cellular module 1121 (e.g., a communication processor), the memory 1130 and the power management module 1195 are separate from the AP 1110, the AP 1110 may include at least a part of the forgoing elements (e.g., the cellular module 1121), according to various embodiments of the present disclosure.

According to an embodiment of the present disclosure, the AP 1110 or the cellular module 1121 (e.g., the communication processor) may load, on a volatile memory, a command or data received from at least one of a nonvolatile memory and other elements connected to the AP 1110 or the cellular module 1121, so as to process the command or data. Furthermore, the AP 1110 or cellular module 1121 may store, in the nonvolatile memory, data received from or generated by at least one of the other elements.

Each of the WiFi module 1123, the BT module 1125, the GPS module 1127 and the NFC module 1128 may include, for example, a processor for processing data transmitted/received through the modules. FIG. 11 illustrates the cellular module 1121, the WiFi module 1123, the BT module 1125, the GPS module 1127 and the NFC module 1128 as if the modules are separate blocks. However, according to an embodiment of the present disclosure, at least a part (e.g., two or more) of the cellular module 1121, the WiFi module 1123, the BT module 1125, the GPS module 1127 and the NFC module 1128 may be included in a single integrated chip (IC) or IC package. For example, at least a part (e.g., a communication processor corresponding to the cellular module 1121 and a WiFi processor corresponding to the WiFi module 1123) of the cellular module 1121, the WiFi module 1123, the BT module 1125, the GPS module 1127 and the NFC module 1128 may be implemented with a single SoC.

The RF module 1129 may transmit/receive data, for example, may transmit/receive an RF signal. Although not illustrated, for example, a transceiver, a power amp module (PAM), a frequency filter or a low noise amplifier (LNA) may be included in the RF module 1129. Furthermore, the RF module 1129 may include a component such as a conductor or a wire for transmitting/receiving free-space electromagnetic waves in a wireless communication system. FIG. 11 illustrates the cellular module 1121, the WiFi module 1123, the BT module 1125, the GPS module 1127 and the NFC module 1128 as if the modules share the single RF module 1129. However, according to an embodiment of the present disclosure, at least one of the cellular module 1121, the WiFi module 1123, the BT module 1125, the GPS module 1127 and the NFC module 1128 may transmit/receive RF signals through an additional RF module.

The SIM card 1124 may include a subscriber identification module, and may be inserted into a slot formed at a specific location of the electronic device. The SIM card 1124 may include unique identification information (e.g., an integrated circuit card identifier (ICCID)) or subscriber information (e.g., international mobile subscriber identity (IMSI)).

The memory 1130 (e.g., the memory 150) may include an internal memory 1132 and/or an external memory 1134. The internal memory 1132 may include at least one of a volatile memory (e.g., a dynamic random access memory (DRAM), a static RAM (SRAM) or a synchronous dynamic RAM (SDRAM)) and a nonvolatile memory (e.g., a one-time PROM (OTPROM), a PROM, an erasable PROM (EPROM), an electrically erasable PROM (EEPROM), a mask ROM, a flash ROM, a not and (NAND) flash memory, or a not or (NOR) flash memory).

According to an embodiment of the present disclosure, the internal memory 1132 may be a solid state drive (SSD). The external memory 1134 may include a flash drive, for example, compact flash (CF), secure digital (SD), micro secure digital (Micro-SD), mini secure digital (Mini-SD), extreme digital (xD) or a memory stick. The external memory 1134 may be functionally connected to the electronic device 1100 through various interfaces. According to an embodiment of the present disclosure, the electronic device 1100 may further include a storage device (or a storage medium) such as a hard drive.

The sensor module 1140 may measure physical quantity or detect an operation state of the electronic device 1100 so as to convert measured or detected information into an electrical signal. The sensor module 1140 may include, for example, at least one of a gesture sensor 1140A, a gyro sensor 1140B, a barometer sensor 1140C, a magnetic sensor 1140D, an accelerometer sensor 1140E, a grip sensor 1140F, a proximity sensor 1140G, a color sensor 1140H (e.g., RGB sensor), a biometric sensor 1140I, a temperature/humidity sensor 1140J, an illuminance sensor 1140K, and an ultraviolet (UV) sensor 1140M. Additionally or alternatively, the sensor module 1140 may include, for example, an olfactory sensor (E-nose sensor, not illustrated), an electromyography (EMG) sensor (not illustrated), an electroencephalogram (EEG) sensor (not illustrated), an electrocardiogram (ECG) sensor (not illustrated), an infrared (IR) sensor (not illustrated), an iris recognition sensor (not illustrated), or a fingerprint sensor (not illustrated). The sensor module 1140 may further include a control circuit for controlling at least one sensor included therein.

The input device 1150 may include a touch panel 1152, a (digital) pen sensor 1154, a key 1156, and/or an ultrasonic input device 1158. The touch panel 1152 may recognize a touch input using at least one of capacitive, resistive, infrared and ultraviolet sensing methods. The touch panel 1152 may further include a control circuit. In the case of using the capacitive sensing method, a physical contact recognition or proximity recognition is allowed. The touch panel 1152 may further include a tactile layer. In this case, the touch panel 1152 may provide tactile reaction to a user.

The (digital) pen sensor 1154 may be implemented, for example, in a similar or same manner as the method of receiving a touch input of a user or may be implemented using an additional sheet for recognition. The key 1156 may include, for example, a physical button, an optical button, or a keypad. The ultrasonic input device 1158, which is an input device for generating an ultrasonic signal, may enable the electronic device 1100 to sense a sound wave through a microphone (e.g., a microphone 1188) so as to identify data, wherein the ultrasonic input device 1158 is capable of wireless recognition. According to an embodiment of the present disclosure, the electronic device 1100 may use the communication module 1120 so as to receive a user input from an external device (e.g., a computer or server) connected to the communication module 1120.

The display 1160 (e.g., the display 150) may include a panel 1162, a hologram device 1164, and/or a projector 1166. The panel 1162 may be, for example, an LCD or an AMOLED. The panel 1162 may be, for example, flexible, transparent or wearable. The panel 1162 and the touch panel 1152 may be integrated into a single module. The hologram device 1164 may display a stereoscopic image in a space using a light interference phenomenon. The projector 1166 may project light onto a screen so as to display an image. The screen may be arranged in the inside or the outside of the electronic device 1100. According to an embodiment of the present disclosure, the display 1160 may further include a control circuit for controlling the panel 1162, the hologram device 1164, or the projector 1166.

The interface 1170 may include, for example, a high definition multimedia interface (HDMI) 1172, a universal serial bus (USB) 1174, an optical interface 1176, or a D-subminiature 1178. The interface 1170 may be included in the communication interface 160 illustrated in FIG. 1. Additionally or alternatively, the interface 1170 may include, for example, a mobile high-definition link (MHL) interface, a secure digital (SD) card/multi-media card (MMC) interface, or an infrared data association (IrDA) interface.

The audio module 1180 may convert a sound into an electrical signal or vice versa. At least a part of the audio module 1180 may be included in the communication interface 140 illustrated in FIG. 1. The audio module 1180 may process sound information input or output through a speaker 1182, a receiver 1184, an earphone 1186, and/or the microphone 1188.

According to an embodiment of the present disclosure, the camera module 1191 for shooting a still image or a video may include at least one image sensor (e.g., a front sensor or a rear sensor), a lens (not illustrated), an image signal processor (not illustrated), or a flash (e.g., an LED or a xenon lamp, not illustrated).

The power management module 1195 may manage power of the electronic device 1110. Although not illustrated, a power management integrated circuit (PMIC), a charging IC, or a battery or fuel gauge may be included in the power management module 1195.

The PMIC may be mounted on an integrated circuit or an SoC semiconductor. A charging method may be classified into a wired charging method and a wireless charging method. The charging IC may charge a battery, and may prevent an overvoltage or an overcurrent from being introduced from a charger. According to an embodiment of the present disclosure, the charging IC may include a charger IC for at least one of the wired charging method and the wireless charging method. The wireless charging method may include, for example, a magnetic resonance method, a magnetic induction method or an electromagnetic method, and may include an additional circuit, for example, a coil loop, a resonant circuit, or a rectifier.

The battery gauge may measure, for example, a remaining capacity of the battery 1196 and a voltage, current or temperature during charging. The battery 1196 may store or generate electricity, and may supply power to the electronic device 1110 using the stored or generated electricity. The battery 1196 may include, for example, a rechargeable battery or a solar battery.

The indicator 1197 may include a specific state of the electronic device 1100 or a part thereof (e.g., the AP 1110), such as a booting state, a message state, and/or a charging state. The motor 1198 may convert an electrical signal into a mechanical vibration. Although not illustrated, a processing device (e.g., a GPU) for supporting a mobile TV may be included in the electronic device 1100. The processing device for supporting a mobile TV may process media data according to the standards of digital multimedia broadcasting (DMB), digital video broadcasting (DVB) or media flow.

Each of the above-mentioned elements of the electronic device according to various embodiments of the present disclosure may be configured with one or more components, and the names of the elements may be changed according to the type of the electronic device. The electronic device according to various embodiments of the present disclosure may include at least one of the above-mentioned elements, and some elements may be omitted or other additional elements may be added. Furthermore, some of the elements of the electronic device according to various embodiments of the present disclosure may be combined with each other so as to form one entity, so that the functions of the elements may be performed in the same manner as before the combination.

The term "module" used herein may represent, for example, a unit including one or more combinations of hardware, software and firmware. The term "module" may be interchangeably used with the terms "unit", "logic", "logical block", "component" and "circuit". The "module" may be a minimum unit of an integrated component or may be a part thereof. The "module" may be a minimum unit for performing one or more functions or a part thereof. The "module" may be implemented mechanically or electronically. For example, the "module" according to various embodiments of the present disclosure may include at least one of an application-specific integrated circuit (ASIC) chip, a field-programmable gate array (FPGA), and a programmable-logic device for performing some operations, which are known or will be developed.

According to various embodiments of the present disclosure, at least a part of devices (e.g., modules or functions thereof) or methods (e.g., operations) according to various embodiments of the present disclosure may be implemented as instructions stored in a non-transitory computer-readable storage medium in the form of a programming module. In the case where the instructions are performed by at least one processor (e.g., the processor 1110), the at least one processor may perform functions corresponding to the instructions. The non-transitory computer-readable storage medium may be, for example, the memory 1130. At least a part of the programming module may be implemented (e.g., executed) by the processor 1110. At least a part of the programming module may include, for example, a module, program, routine, sets of instructions, or process for performing at least one function.

The non-transitory computer-readable storage medium may include a magnetic medium such as a hard disk, a floppy disk and a magnetic tape, an optical medium such as a compact disk read only memory (CD-ROM) and a DVD, a magneto-optical medium such as a floptical disk, and a hardware device configured to store and execute program instructions (e.g., programming module), such as a ROM, a RAM and a flash memory. The program instructions may include machine language codes made by compilers and high-level language codes that can be executed by computers using interpreters. The above-mentioned hardware may be configured to be operated as one or more software modules for performing operations of various embodiments of the present disclosure and vice versa.

The module or programming module according to various embodiments of the present disclosure may include at least one of the above-mentioned elements, or some elements may be omitted or other additional elements may be added. Operations performed by the module, the programming module or the other elements may be performed in a sequential, parallel, iterative or heuristic way. Furthermore, some operations may be performed in another order or may be omitted, or other operations may be added.

An electronic device and a display control method thereof according to various embodiments of the present disclosure can provide a user with contents of optimal image quality that is flexible to an incident light.

An electronic device and a display control method thereof according to various embodiments of the present disclosure can calculate optical white balance in various illuminant environments by enabling the optimal white balance to be calculated even in a case where an incident light is not located on a blackbody locus in a space where the incident light is defined with color coordinates.

While the present disclosure has been shown and described with reference to various embodiments thereof, it will be understood by those skilled in the art that various changes in form and details may be made therein without departing from the spirit and scope of the present disclosure as defined by the appended claims and their equivalents.

What is claimed is:

1. A method for displaying content on a display of an electronic device, the method comprising:

sensing, by at least one sensor included in the electronic device, chromaticity and illuminance of a light;

determining, by at least one processor included in the electronic device, whether the sensed illuminance of the light is above or below a first reference illuminance;

displaying the content on the display based on a first white value calculated using at least the sensed chromaticity when the sensed illuminance of the light is above the first reference illuminance; and displaying, when the sensed illuminance of the light is below the first reference illuminance, the content on the display based on a second white value, calculated to correct optimal white at the sensed illuminance by linearly interpolating the second white value from between a predetermined red (R), green (G), and blue (B) (RGB) grayscale value of the optimal white at the first reference illuminance and a maximum grayscale value.

2. The method of claim 1, wherein the first white value is calculated by interpolating the optimal white between an RGB grayscale value of the optimal white at the first reference illuminance and an RGB grayscale value of the optimal white at a second reference illuminance by using a logarithmic function, when the illuminance of the light is above the first reference illuminance and below the second reference illuminance.

3. The method of claim 1, wherein displaying the content on the display based on the first white value includes:

classifying color types of the light; and setting any one of grayscale values of RGB of the chromaticity as a maximal grayscale value based on the classified color types, and calculating grayscale values in the optimal white for any remaining RGB for which the grayscale values of the chromaticity are not set as the maximal grayscale value.

4. The method of claim 3, wherein the classifying of the color types of the light includes normalizing grayscale values of RGB of the chromaticity of the light.

5. An electronic device comprising:

a display configured to display a content;

at least one sensor configured to sense chromaticity and illuminance of a light;

a memory storing instructions; and at least one processor electronically connected to the display, the at least one sensor, and the memory, and configured to execute the stored instructions to:

determine whether the sensed illuminance of the light is above a first reference illuminance, control the display to display the content based on a first white value calculated using at least the sensed chromaticity when the sensed illuminance of the light is above the first reference illuminance, and control the display to display, when the sensed illuminance of the light is below the first reference illuminance, the content based on a second white value, calculated to correct optimal white at the sensed illuminance by linearly interpolating the second white value from between a red (R), green (G), and blue (B) (RGB) grayscale value of the optimal white at the first reference illuminance and a maximum grayscale value.

6. The electronic device according to claim 5, wherein the first white value is calculated by interpolating the optimal white between an RGB grayscale value of the optimal white at the first reference illuminance and an RGB grayscale value of the optimal white at a second reference illuminance by using a logarithmic function, when the illuminance of the light is above the first reference illuminance and below the second reference illuminance.

7. The electronic device according to claim 5, wherein the at least one processor is further configured to calculate the first white value based on a relative arrangement of the at least one sensor and the display.

8. The electronic device according to claim 7, wherein the at least one processor is further configured to calculate the first white value according to the light irradiated on the display, when the at least one sensor is arranged in a same direction as the display.

9. The electronic device according to claim 7, wherein the at least one processor is further configured to calculate the first white value according to a reflection light reflected by an object around the electronic device, when the at least one sensor is arranged in a different direction from the display.

10. The electronic device according to claim 5, wherein the first white value is calculated based on a first set of RGB grayscale values and the second white value is calculated based on a second set of RGB grayscale values.

11. The electronic device according to claim 10, wherein the first set of RGB grayscale values is based on grayscale values with the optimal white experimentally determined and previously stored.

12. The electronic device according to claim 10, wherein the second set of RGB grayscale values is calculated based on minimizing an effect of an incident light on a screen of the electronic device.

* * * * *